United States Patent [19]

Ward

[11] 4,002,866

[45] Jan. 11, 1977

[54] ELECTRIC SWITCHES

[75] Inventor: William E. Ward, Clanfield, England

[73] Assignee: Illinois Tool Works Inc., Chicago, Ill.

[22] Filed: Apr. 18, 1975

[21] Appl. No.: 569,528

[30] Foreign Application Priority Data

Apr. 19, 1974 United Kingdom ..... 17338/74

[52] U.S. Cl. ..... 200/67 D

[51] Int. Cl.[2] ..... H01H 13/36

[58] Field of Search ..... 200/67 R, 67 D; 74/100 D

[56] References Cited

UNITED STATES PATENTS

| | | | |
|---|---|---|---|
| 2,541,370 | 2/1951 | Koonz et al. | 200/67 D |
| 2,813,946 | 11/1957 | Cox | 200/67 D |
| 3,194,911 | 7/1965 | Sherwood | 200/67 D |

FOREIGN PATENTS OR APPLICATIONS

| | | |
|---|---|---|
| 1,250,979 | 10/1971 | United Kingdom |

*Primary Examiner*—David Smith, Jr.
*Attorney, Agent, or Firm*—Glenn W. Bowen; Robert W. Beart

[57] ABSTRACT

A snap-action electric switch comprising a housing; a first contact member which is of resilient flexible material and includes a frame defining a central window, the frame lying generally in a plane and consisting of a base, two opposite sides, and a tip, the base being fixed in the housing and the remainder of the frame being movable; a fulcrum aligned with the window and fixed in the housing; a second contact member, fixed in the housing adjacent to the tip of the first contact member; a stop fixed in the housing adjacent to the tip; and an actuating member having a central bore the axis of which is transverse to the general plane of the frame, and the cross section of which is aligned with the window, the actuating member being able to reciprocate relatively to the housing in the direction of the axis of the bore, and the actuating member having abutments cooperating with the sides of the frame; the first contact member including a tongue projecting into the window from adjacent to the tip of the frame, and terminating in an end which is in compressive engagement with the fulcrum.

11 Claims, 8 Drawing Figures

ELECTRIC SWITCHES

This invention relates to electric switches and relates more specifically to electric switches for use in gas appliances (e.g. gas cookers) for gas ignition purposes.

An electric switch according to the present invention comprises a housing; a first contact member which is of resilient flexible material and includes a frame defining a central window, the frame lying generally in a plane and consisting of a base, two opposite sides, and a tip, the base being fixed in the housing and the remainder of the frame being movable; a fulcrum aligned with the window and fixed in the housing; a second contact member, fixed in the housing adjacent to the tip of the first contact member; a stop fixed in the housing adjacent to the tip; and an actuating member having a central bore the axis of which is transverse to the general plane of the frame, and the cross section of which is aligned with the window, the actuating member being able to reciprocate relatively to the housing in the direction of the axis of the bore, and the actuating member having abutments cooperating with the sides of the frame; the first contact member including a tongue projecting into the window from adjacent to the tip of the frame, and terminating in an end which is in compressive engagement with the fulcrum, and the proportions of the switch being such that a predetermined stroke of the actuating member will cause the first contact member to snap from a first extreme position to a second extreme position, and release of the actuating member will enable the first contact member to snap back to the first extreme position, the tip making firm engagement with the second contact member when in one of the said extreme positions, and being spaced from the second contact member and in engagement with the stop when in the other of the said extreme positions.

Preferably the first contact member is of sheet metal of uniform thickness, carrying a contact stud on the tip of the frame, and the first contact member is bilaterally symmetrical about a plane containing the axis of the bore in the actuator and passing through the contact stud.

Preferably the first contact member has a second tongue also projecting into the window from adjacent to the tip of the frame, the two tongues diverging from each other away from the tip; and there is a second fulcrum aligned with the window and fixed in the housing, the second tongue terminating in an end which is in compressive engagement with the second fulcrum.

Preferably each fulcrum is defined by a respective step surface parallel to the general plane of the frame and by a respective shoulder surface perpendicular to the said general plane, and the step surfaces are in a common plane parallel to a line joining the junctions of the sides of the frame with the base.

Preferably the two tongues are each curved along their length, both being concave relative to the general plane of the frame in the same sense, and the compressive engagement causes strains which increase the concavity of the tongues.

Preferably the housing comprises a body and a cover, the body being an integral moulding of a plastics material containing a strong filler; the actuating member is in the form of a sleeve around the bore, with diametrically opposite pins which constitute the abutments; the body includes a boss which extends through the window, carries surfaces which define the fulcrum or fulcra, defines a central passage which guides the reciprocation of the actuating member, and defines slots which guide the reciprocation of the abutments; and the cover is secured to the body and thereby traps the first and second contact members in the housing and confines the actuating member to limited strokes.

For an on-off switch, the stop may be a part of the housing, for example on the cover. The switch may be arranged as normally-open or as normally-closed. For a two-way switch, the stop may be constituted by a third contact member.

The accompanying drawings show one example of a snap-action electric switch according to the invention. In these drawings.

Figure 1:
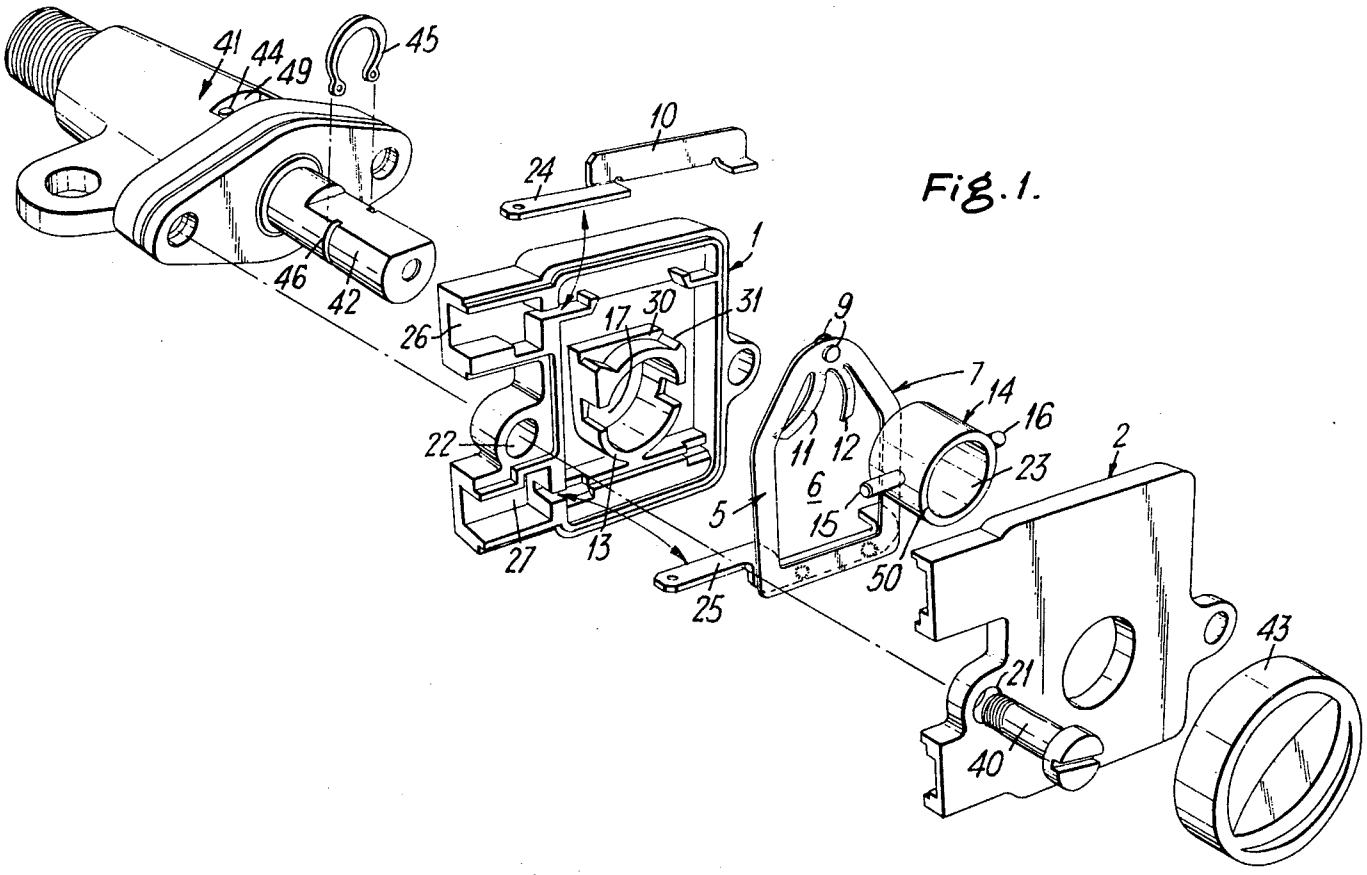
FIG. 1 is an exploded perspective view of the gas tap and switch.
Figure 2:
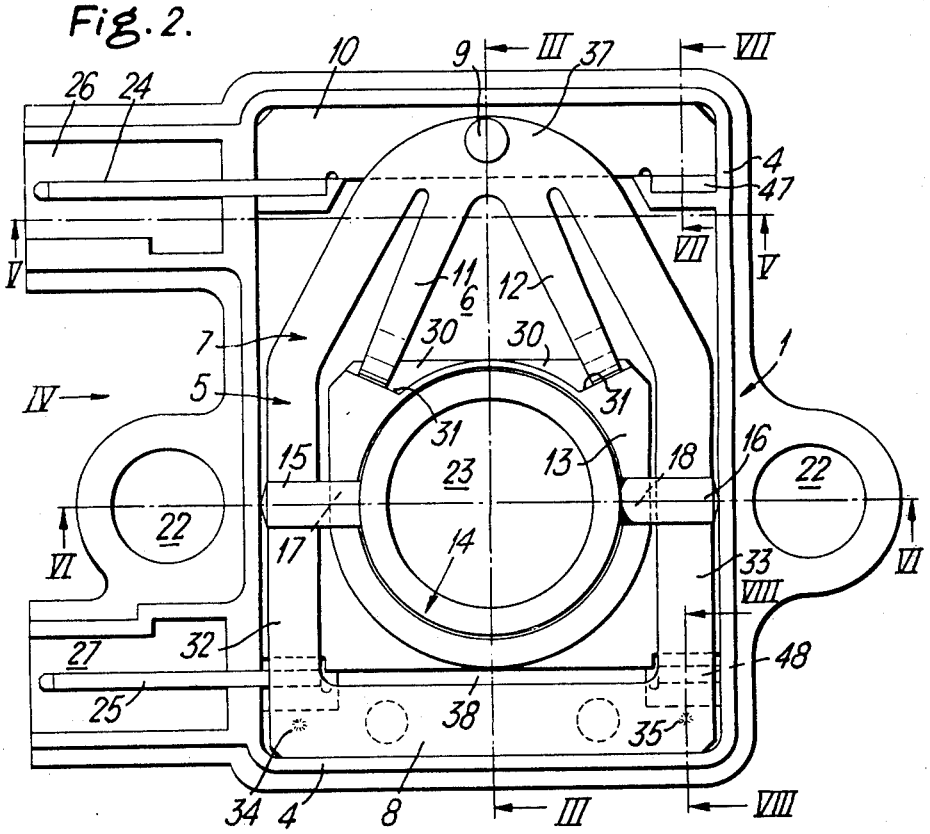
FIG. 2 is a view of the switch with the cover removed, looking from the line II in FIG. 3.

Referring to the drawing, the switch illustrated comprises a plastics-moulded housing formed in two parts, namely a body 1 and a cover 2. When the switch has been assembled, a rim 3 on the cover grips a flange 4 on the body.

Figure 8:
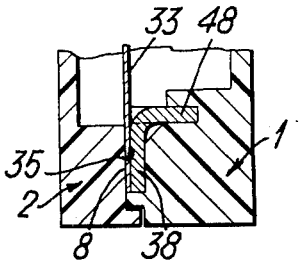

The switch housing accommodates an over-centre snap-action switching mechanism which includes a springy contact member 7 which is of sheet metal of uniform thickness, and includes a frame 5 defining a central window 6. The frame, when unstressed, is flat. It is bilaterally symmetrical, and consists of a base 8, two opposite sides 32, 33 and a tip 37. The base 8 is spot welded at 34, 35 to a metal bar 38, and clamped between opposed surfaces of the housing parts 1 and 2 as shown in FIG. 8. The tip 37 of the contact member 7 is free to move and carries a moving contact 9 which co-operates with a fixed contact bar 10.

The contact member 7 also includes integral tongues 11 and 12 which extend from adjacent to the tip 37, into the window 6, and diverge from each other. The tongues terminate in free ends which engage abutments constituted by fulcra in a boss 13 integral with the housing part 1. Each fulcrum is defined by a step surface 30, and by a shoulder surface 31. The step surfaces 30 are in a common plane parallel to the base 8 of the contact member 7. The shoulder surfaces 31 are perpendicular to that plane, and each perpendicular to the respective tongue 11, 12. The tongues are curved when unstressed, both being concave in the same sense, and the position of the shoulder surfaces 31 is such that the tongues are in longitudinal compression, and therefore more concave, in the assembled condition.

For the actuation of the over-centre snap action switch mechanism, a plastics-moulded hollow cylindrical actuating member 14 is provided, which extends through the boss 13 and which is prevented from rotating by means of moulded pins 15 and 16 which lie in slots 17, 18 in the boss 13, and abut the sides 32, 33 of the contact member 7.

To actuate the switch, the actuating member 14 is displaced axially against the normal biasing action of the contact member 7 on the actuating member 14. This displacement causes flexing of the sides 32, 33 of the contact member 7, so as to cause the point of flexing to pass from one side of the line joining the fulcra on the boss 13 and the moving contact 9, to the other side of the line, so that the moving contact 9 snaps to engage with the fixed contact bar 10.

Figure 7:
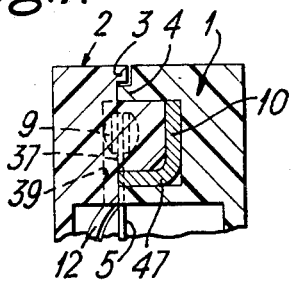
FIGS. 7 and 8 are fragmentary sections on the lines VII—VII and VIII—VIII in FIG. 2.
Figure 3:
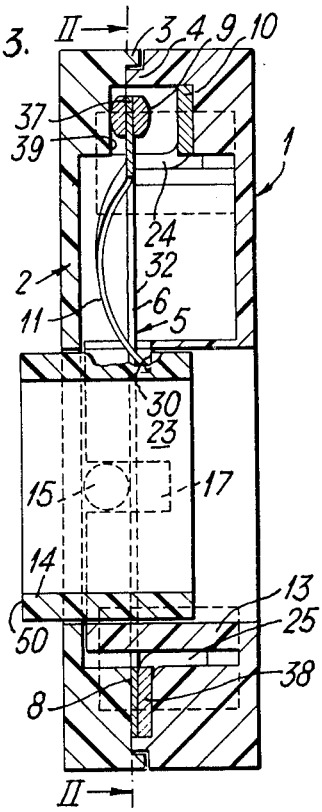
FIG. 3 is a section of the assembled switch, on the line III—III of FIG. 2.
Figure 4:
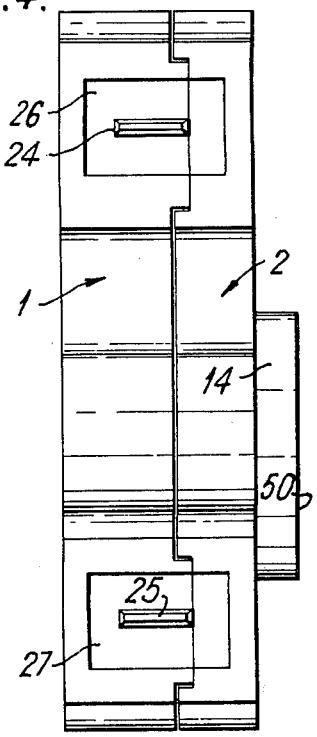
FIG. 4 is a side elevation of the switch, looking in the direction of the arrow IV in FIG. 2.
Figure 5:
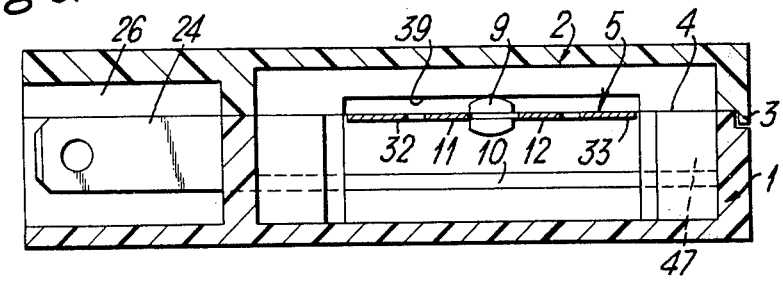
FIGS. 5 and 6 are sections on the lines V-V and VI—VI in FIG. 2.
Figure 6:
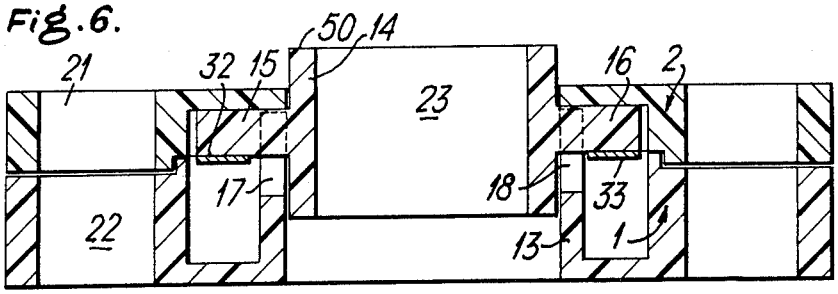

When the actuating member 14 is released, the biasing action of the contact member 7 returns the actuating member 14 and the contact member 7 to their initial positions. When this happens, the moving contact 9 snaps away from the contact bar 10, and moves until the opposite face of the moving contact 9 engages a stop 39 (FIGS. 3, 5 and 7) on the cover part 2 of the housing.

The switch is intended to be mounted (see FIG. 1), by screws 40 extending through holes 21 and 22 of the housing, on the gas tap assembly 41 of a gas cooker, with the usual spindle 42 of the gas tap passing through a central bore 23 in the actuating member 14. In operation of the cooker, a control knob 43 fixed on the spindle will be pressed and turned to release gas to the burner concerned. As the knob 43 is pressed, a circlip 45, mounted in a groove 46 in the spindle, engages an end face 50 of the actuating member 14. This end face projects from the switch housing. The last small part of the axial movement of the control knob 43 and spindle 42 will cause the switch to be operated. This completes an electrical gas-ignition circuit which will provide sparks between electrodes in the vicinity of the burner for igniting the gas. Such circuits are known and are not part of this invention. When the pressure on the knob 43 is released, the switch will return to normal condition, under the action of the springy contact member 7, so as to disconnect the gas ignition circuit. This return action will occur, whatever the rotary position of the knob 43. The gas tap assembly 41 incorporates an L-shaped slot cooperating with a pin 44 on the spindle 42. The limb 49 of the slot is a little wider than the pin, so that the spindle, which is urged outwards by a spring (not shown) within the assembly 41, can move axially sufficiently to open and close the switch.

The contact bar 10 and the bar 38 have blade terminal portions 24 and 25 which are held in position by the interlocking housing parts 1 and 2 and are arranged to be engaged by socket terminals of connecting wires (not shown) which will be press-fitted into cavities 26 and 27. The bars 10 and 38 are each of sheet metal, and the central portion of each bar lies parallel to the general plane of the frame of the contact member 7, whereas the terminal portions 24, 25 and also lugs 47, 48, lie in planes perpendicular to that plane.

In order to attain long life, especially at the fulcra, the housing parts are preferably moulded of a plastics material containing a strong filler, e.g. glass-reinforced nylon.

In the example so far described, the actuating member 14 is moved axially as a consequence of axial movement of the spindle 42 which passes through the actuating member and carries the circlip 45. In an alternative arrangement, the gas tap spindle motion is rotary only, and the switch is modified so as to be operated by this rotary motion.

The modification involves reducing the axial length of the actuating member 14 so that the face 50 lies within the housing, altering the shape of the end face 50, and adding to the switch a cam member in axial alignment with the actuating member, while the circlip 45 on the spindle is omitted. The cam member has a D-shaped bore in which the spindle 42 fits, so that the cam member is rotated by the spindle. The cam member is journalled in the circular opening in the cover 2 of the housing, and has a flange bearing against the inner face of the cover. The cam member has an end face which abuts the end face of the actuating member. These end faces are shaped so that rotation of the cam member relative to the housing causes axial movement of the actuating member relative to the housing. For example, the end face of the actuating member may be flat, but in a plane at an angle less than 90° to the axis (e.g. at 80°), while the end face of the cam member has a protuberance which alone engages the actuating member. Alternatively, each abutting end face may be part of an axially-facing helical surface.

It may be necessary to increase the depth of the housing to accommodate the cam member.

As another alternative, the cam member may be outside the housing, and be fixed to the spindle by a grub screw, a pin, or otherwise, while the actuating member presents a cooperating end face through the opening in the cover.

I claim:

1. An electrical switch for a gas valve having a shaft for opening the valve by rotation of the shaft comprising a housing having a generally cylindrically-shaped hollow boss integrally formed thereon; a first contact member which is of resilient flexible material and includes a frame defining a central window, the frame lying generally in a plane and consisting of a base, two opposite sides, and a tip, the base being fixed in the housing and the remainder of the frame being movable; a fulcrum formed on said boss and aligned with the window and fixed in the housing; a second contact member, fixed in the housing adjacent to the tip of the first contact member; a stop fixed in the housing adjacent to the tip; and a hollow cylindrically-shaped actuating member having a central bore, the axis of which is transverse to the general plane of the frame, and the cross-section of which is aligned with the window; a control member adjacent said actuating member which may be reciprocated and rotated simultaneously, the actuating member being able to reciprocate in said boss and to be guided by said boss relatively to the housing in the direction of the axis of the bore, when said actuating member is contacted by said control member, and the actuating member having a pair of diametrically opposed pins aligned with each other and extending in opposite directions from said actuating member cooperating with the sides of the frame; said boss being formed with a pair of parallel slots on opposite sides of said boss which receive said pins therein and which guide said pins so as to restrain the actuating member from rotating during actuation and deactuation of the switch, but which will allow for rotation of said shaft of said gas valve when said shaft is rotated by said control member; the first contact member including a tongue projecting into the window from adjacent to the tip of the frame, and terminating in an end which is in compressive engagement with the fulcrum, and the proportions of the switch being such that a predetermined stroke of the actuating member will cause the first contact member to snap from a first extreme position to a second extreme position, and release of the actuating member will enable the first contact member to snap back to the first extreme position, the tip making firm engagement with the second contact member when in one of the said extreme positions, and being spaced from the second contact member and in engagement with the stop when in the other of said extreme positions.

2. A switch according to claim 1, in which the first contact member is of sheet metal of uniform thickness, carrying a contact stud on the tip of the frame.

3. A switch according to claim 2, in which the first contact member is bilaterally symmetrical about a plane containing the axis of the bore in the actuator and passing through the contact stud.

4. A switch according to claim 3, in which the first contact member has a second tongue also projecting into the window from adjacent to the tip of the frame, the two tongues diverging from each other away from the tip; and there is a second fulcrum formed on said boss and aligned with the window and fixed in the housing, the second tongue terminating in an end which is in compressive engagement with the second fulcrum.

5. A switch according to claim 4, in which each fulcrum is defined by a respective step surface on said boss parallel to the general plane of the frame and by a respective shoulder surface on said boss perpendicular to the said general plane, and the step surfaces are in a common plane parallel to a line joining the junctions of the sides of the frame with the base.

6. A switch according to claim 4, in which the two tongues are each curved along their length, both being concave relative to the general plane of the frame in the same sense, and the compressive engagement causes strains which increase the concavity of the tongues.

7. A switch according to claim 1, in which the second contact member is a metal bar, and the base of the first contact member is in fixed conductive association with a further metal bar, and each bar has a respective terminal portion accessible from outside the housing.

8. A switch according to claim 7, in which each bar is of sheet metal, and the terminal portions are in planes perpendicular to the general plane of the frame, whereas the remainder of each bar is parallel to the said general plane.

9. A switch according to claim 1, in which the housing comprises a body and a cover, the body being an integral moulding of a plastics material containing a strong filler; and the cover is secured to the body and thereby traps the first and second contact members in the housing and confines the actuating member to limited strokes.

10. A switch according to claim 9, in which the body of the housing is of glass-reinforced nylon.

11. A switch according to claim 9, in which the stop is on the cover.

* * * * *